US007467730B2

(12) United States Patent
Manke et al.

(10) Patent No.: US 7,467,730 B2
(45) Date of Patent: Dec. 23, 2008

(54) PAINT CONTAINER HANDLE

(75) Inventors: Scott G. Manke, Sun Prairie, WI (US); Mark A. Gilbertson, Prairie du Sac, WI (US); David N. Woods, Madison, WI (US)

(73) Assignee: Masterchem Industries, LLC, Imperial, MI (US)

( * ) Notice: Subject to any disclaimer, the term of this patent is extended or adjusted under 35 U.S.C. 154(b) by 388 days.

(21) Appl. No.: 10/888,301

(22) Filed: Jul. 9, 2004

(65) Prior Publication Data

US 2005/0006398 A1 Jan. 13, 2005

Related U.S. Application Data

(60) Provisional application No. 60/485,674, filed on Jul. 9, 2003.

(51) Int. Cl.
*B65D 1/42* (2006.01)

(52) U.S. Cl. ..... 220/760

(58) Field of Classification Search ..... None
See application file for complete search history.

(56) References Cited

U.S. PATENT DOCUMENTS

| | | | |
|---|---|---|---|
| 1,196,492 | A | 8/1916 | Sykes |
| 1,199,680 | A | 9/1916 | Fabian |
| 1,333,917 | A | 3/1920 | Hollands |
| 1,488,397 | A | 3/1924 | Judge et al. |
| 1,873,624 | A | 8/1932 | Moxey |
| 1,893,604 | A | 1/1933 | Van Rossem |
| 2,120,487 | A | 6/1938 | Conner |
| 2,324,338 | A | 7/1943 | Tripp |
| 2,387,270 | A | 10/1945 | Johnson |
| 2,935,223 | A | 5/1960 | Crowley |
| 3,138,284 | A | 6/1964 | Henchert |

(Continued)

FOREIGN PATENT DOCUMENTS

| | | |
|---|---|---|
| BE | 518014 | 3/1953 |

(Continued)

OTHER PUBLICATIONS

PCT International Search Report and Written Opinion based on International Application No. PCT/US2004/021908, mailed Mar. 30, 2005, 10 pages.

(Continued)

*Primary Examiner*—Stephen J. Castellano
(74) *Attorney, Agent, or Firm*—Foley & Lardner LLP

(57) ABSTRACT

A system for containing paint is disclosed. The system comprises a body between a cover and a base. The system also comprises a handle configured for attachment to the body and selectively configurable between a first position and a second position. The system also comprises a locking mechanism. The locking mechanism comprises a protrusion configured for insertion into a recess of the body. The locking mechanism also comprises a tab of the handle configured for selective insertion into a track of the body. The locking mechanism is configured to inhibit movement of the handle in at least two planes when the handle is in the first position. A method of using a container for paint is also disclosed. A system for containing paint comprising means for locking the handle to the body is also disclosed.

23 Claims, 5 Drawing Sheets

U.S. PATENT DOCUMENTS 3,158,284 A 11/1964 Henchert et al.
3,220,048 A 11/1965 Wei
3,275,366 A 9/1966 Hidding
D208,276 S 8/1967 Moore
3,387,749 A 6/1968 Godshalk et al.
3,412,887 A 11/1968 Swartwood et al.
3,419,196 A 12/1968 Moore
3,451,590 A 6/1969 Johnson et al.
3,620,410 A 11/1971 Greise, Jr.
3,866,791 A 2/1975 Roper et al.
3,924,775 A 12/1975 Andreaggi et al.
4,189,804 A 2/1980 Flowerday
4,227,623 A 10/1980 Woinarski
4,387,922 A 6/1983 Geisinger
4,399,926 A 8/1983 Eidels-Subovoy
4,446,986 A 5/1984 Bowen et al.
4,474,303 A 10/1984 Maccise
D276,890 S * 12/1984 Hancher ..... D9/522
4,601,406 A 7/1986 Dudzik
4,632,888 A 12/1986 Kump et al.
4,643,325 A 2/1987 Streit
4,713,064 A 12/1987 Bruno et al.
4,752,543 A 6/1988 Anderson et al.
4,799,306 A 1/1989 Collins et al.
4,895,269 A 1/1990 Cade
4,896,415 A 1/1990 Bock
4,941,586 A 7/1990 Tarna
D323,115 S 1/1992 Kelsey
5,176,281 A 1/1993 Fiore
5,184,749 A 2/1993 Attenasio
5,226,553 A 7/1993 Fiore
5,269,438 A 12/1993 Kelsey
5,287,990 A 2/1994 Knox
5,337,910 A 8/1994 Picozza et al.
5,339,487 A 8/1994 Kasper
5,344,041 A 9/1994 Luburic et al.
D355,366 S 2/1995 Bainton
5,415,956 A 5/1995 Ching
5,445,425 A 8/1995 Lyver
D362,180 S 9/1995 Haines
5,457,850 A 10/1995 Knox
5,461,755 A 10/1995 Gatlin
5,469,986 A 11/1995 Jang
5,472,111 A 12/1995 Renfrew
5,505,331 A 4/1996 Rathbun
5,507,543 A 4/1996 Shefflin
5,533,802 A 7/1996 Garganese
D374,178 S 10/1996 Valls et al.
5,579,556 A 12/1996 Chung
5,637,420 A 6/1997 Jones, Jr. et al.
5,669,526 A 9/1997 Keyfauver
5,704,506 A 1/1998 Tobias et al.
5,823,385 A 10/1998 Cautereels
5,893,489 A 4/1999 Giarrante
5,896,993 A 4/1999 Nask et al.
5,931,324 A 8/1999 Lyons et al.
5,941,427 A 8/1999 Speer
5,988,418 A 11/1999 Maeshima
6,179,158 B1 1/2001 Koda
6,186,352 B1 2/2001 Hwang
6,213,338 B1 4/2001 Cogdill
6,230,925 B1 5/2001 Hardigg et al.
6,234,364 B1 5/2001 Nybakke et al.
6,257,440 B1 7/2001 Perkins et al.
6,293,692 B1 9/2001 Bowsher et al.
RE37,518 E 1/2002 Hardigg et al.
6,494,341 B2 12/2002 Perkins et al.
6,530,500 B2 3/2003 Bravo et al.
D474,115 S 5/2003 Walsh et al.
D475,628 S 6/2003 Walsh et al.
D478,820 S 8/2003 Walsh et al.
D480,973 S 10/2003 Nottingham et al.
6,634,525 B2 10/2003 Bravo et al.
D489,973 S 5/2004 Root et al.
2002/0195471 A1 12/2002 Nottingham et al.
2003/0102339 A1 6/2003 Walsh et al.
2003/0102340 A1 6/2003 Walsh et al.
2003/0111489 A1 6/2003 Bravo et al.
2003/0121941 A1 7/2003 Walsh et al.
2003/0214878 A1 11/2003 Huckby

FOREIGN PATENT DOCUMENTS

EP 0 599 028 B1 6/1994
GB 675 281 7/1952
GB 2 024 309 A 1/1980
GB 2 095 214 A 9/1982
GB 2 110 637 A 6/1983
GB 2 166 706 A 5/1986
GB 2 251 431 A 7/1992
GB 2 262 929 A 7/1993
GB 2 284 587 A 6/1995
WO WO 92/06013 A1 4/1992
WO WO 93/02928 A1 2/1993
WO WO 02/085713 A1 10/2002
WO WO 03/047881 A1 6/2003

OTHER PUBLICATIONS

Flambeau, 2004 Spring Buying Guide (17 pages).
Photograph of a Flambeau Handle (1 page).

* cited by examiner

FIGURE 5
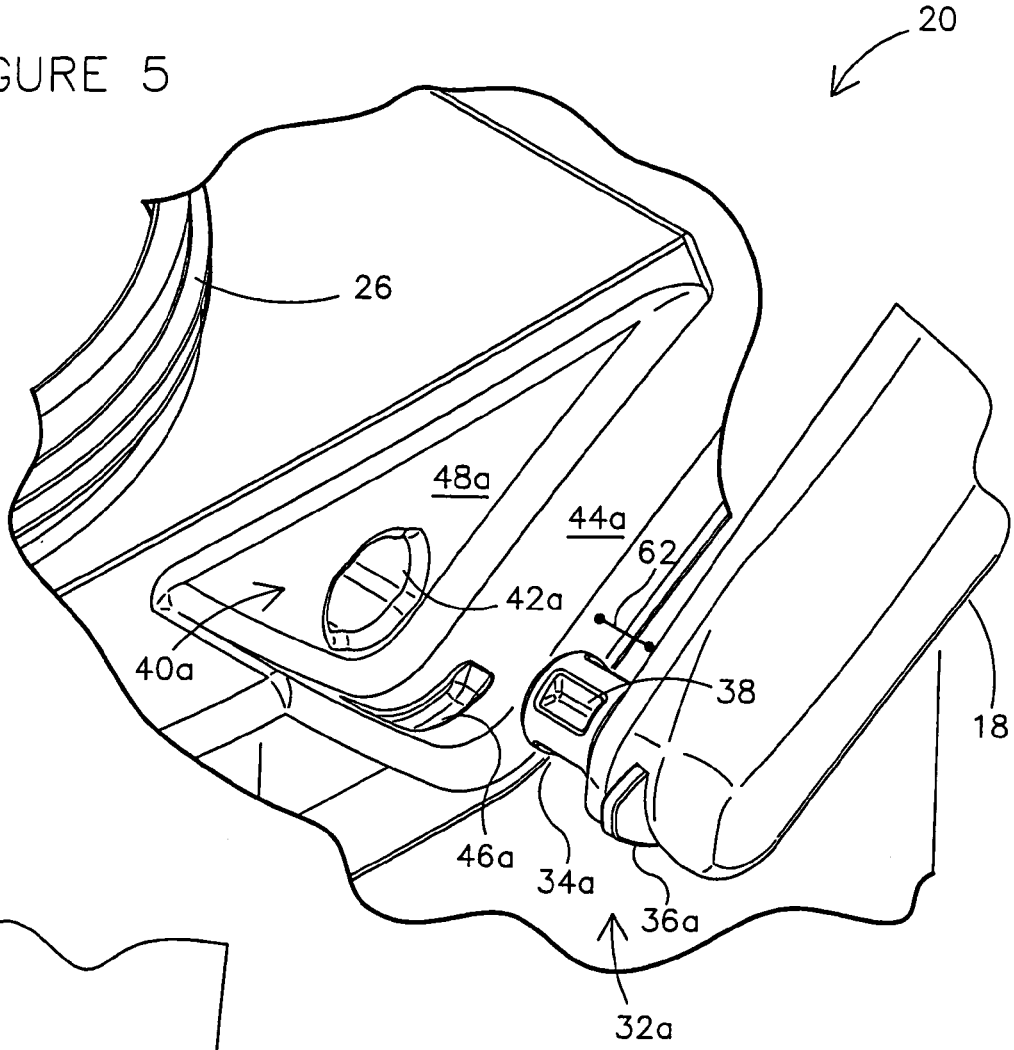
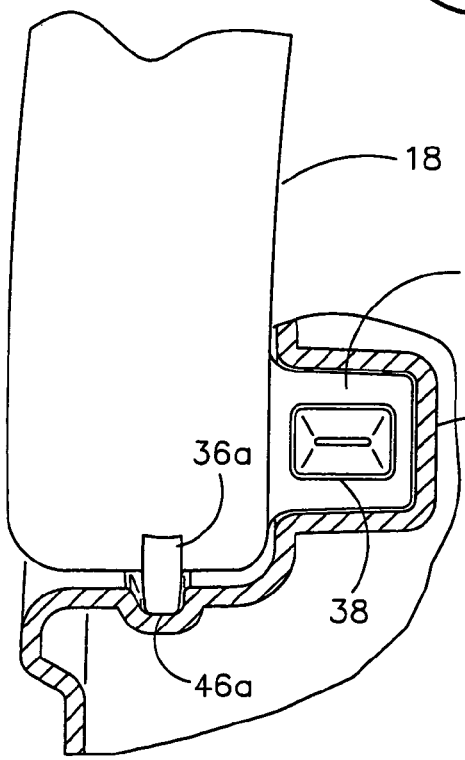
FIGURE 6

PAINT CONTAINER HANDLE

CROSS-REFERENCE TO RELATED PATENT APPLICATIONS

This application claims the benefit of U.S. Provisional Application No. 60/485,674 filed Jul. 9, 2003, which is incorporated herein by reference.

The following U.S. Patent Applications are cited by reference and incorporated by reference herein: U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001.

FIELD

The present invention relates generally to the field of a paint container and more particularly to a system for containing paint having a locking mechanism for inhibiting movement of a handle in at least two planes.

BACKGROUND OF THE INVENTION

It is generally known to provide a container for paint. Such known containers are typically a cylindrical one gallon metal container. The metal container includes a round base and a cylindrical side wall attached to and extending from the base.

The handle of such known containers is a thin curved wire member comprised of a 0.105 gauge material. However, such handle digs into a user's hand under the weight of the paint and the container, and makes such known metal containers difficult to carry. Further, the curved wire handle requires handle pivot or "ear" supports to be added to the outer surface of the cylindrical can, which add assembly and material costs to the container. In addition, the handle may be inadvertently removed from the pivot supports. Furthermore, the pivot supports affect how such known containers must be packed for shipping and for display. Since the pivot supports extend outward from such known containers, additional space between containers (or placement such that the pivot supports are in the "dead" space zone between the containers) is required.

It would be desirable to provide a paint container that is easy to hold using a handle. It would further be desirable to provide a paint container having a handle that is easy to install. It would further be desirable to provide a paint container having a handle that is securely locked to the container in the use and the storage positions. It would also be desirable to provide a container well-suited for packaging and shipping. It would still further be desirable to provide a paint container having one or more of these or other advantageous features.

SUMMARY OF THE INVENTION

The present invention relates to a system for containing paint. The system comprises a body between a cover and a base. The system also comprises a handle configured for attachment to the body and selectively configurable between a first position and a second position. The system also comprises a locking mechanism. The locking mechanism comprises a protrusion configured for insertion into a recess of the body. The locking mechanism also comprises a tab of the handle configured for selective insertion into a track of the body. The locking mechanism is configured to inhibit movement of the handle in at least two planes when the handle is in the first position.

The present invention also relates to a method of using a container for paint. The container comprises a body having a side wall between a cover and a base. The container also comprises a handle configured for attachment to the side wall. The container also comprises a first protrusion and a second protrusion of the handle each configured for insertion into at least one recess of the side wall. The container also comprises a tab of the handle configured for selective insertion into a track of the body. The method comprises positioning the handle in an installation position. The method also comprises biasing the first protrusion away from the second protrusion. The method also comprises inserting the first protrusion in the recess of the side wall to inhibit movement of the handle between a forward position and a rearward position relative to the base.

The present invention also relates to a system for containing paint. The system comprises a body. The system also comprises a handle configured for attachment to the body and selectively configurable between a first position and a second position. The system also comprises means for locking the handle to the body. The means for locking is configured to inhibit movement of the handle in at least two planes when the handle is in the first position.

It is important to note that the term "paint" as used in this disclosure is intended to be a broad term and not a term of limitation. The term "paint" as used in this disclosure may include, without limitation any decorative or functional surface treatment, liquid dispersion, finish, surface finish, varnish, pigment, colorant, other coating, etc.

It is also important to note that the terms "up," "down," "forward," "aft," etc. as used in this disclosure with reference to the embodiments shown in the FIGURES are intended to be broad terms and not terms of limitation. It will be understood, however, that the paint container and the handle shown in the FIGURES may be positioned in any of a variety of orientations and the orientations illustrated in the FIGURES is not intended to be limiting.

BRIEF DESCRIPTION OF THE DRAWINGS

FIG. 5 is a fragmentary exploded perspective view of the system for containing paint of FIG. 1 according to a preferred embodiment.

FIG. 6 is a fragmentary sectional view of a locking mechanism of the system for containing paint of FIG. 1 showing the handle in the use position according to an exemplary embodiment.

DETAILED DESCRIPTION OF THE PREFERRED EMBODIMENTS

Figure 1:
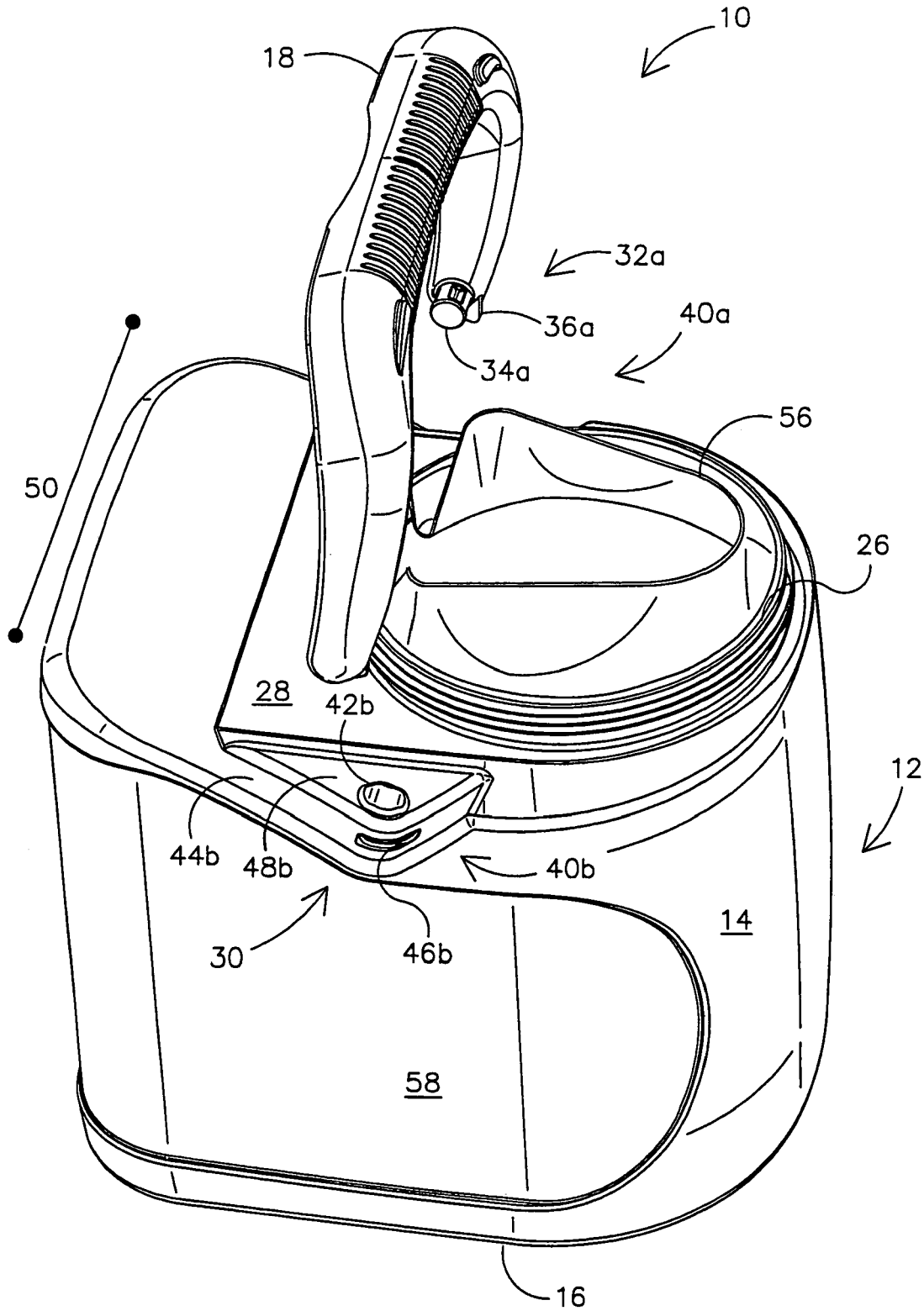
FIG. 1 is an exploded perspective view of a system for containing paint according to a preferred embodiment.

Referring to FIG. 1, a system for containing paint (shown as a paint container 10) is shown according to a preferred embodiment. Container 10 includes a body 12 formed by a vertical side wall 14 extending between a horizontal cover 28 and a horizontal base 16. A bail or handle 18 is attached to side wall 14 of body 12 by a locking system or mechanism 30. Handle 18 is selectively configurable between a horizontal "down" or closed storage position 20 (see FIG. 2) and a vertical "up" or open use position 22 (see FIG. 3). A cap or lid 24 is shown in FIG. 2 threadably attached to a neck 26 having a pour spout 56 (see FIG. 1) which may be selectively inserted into neck 26 for removing paint from container 10.

Figure 2:
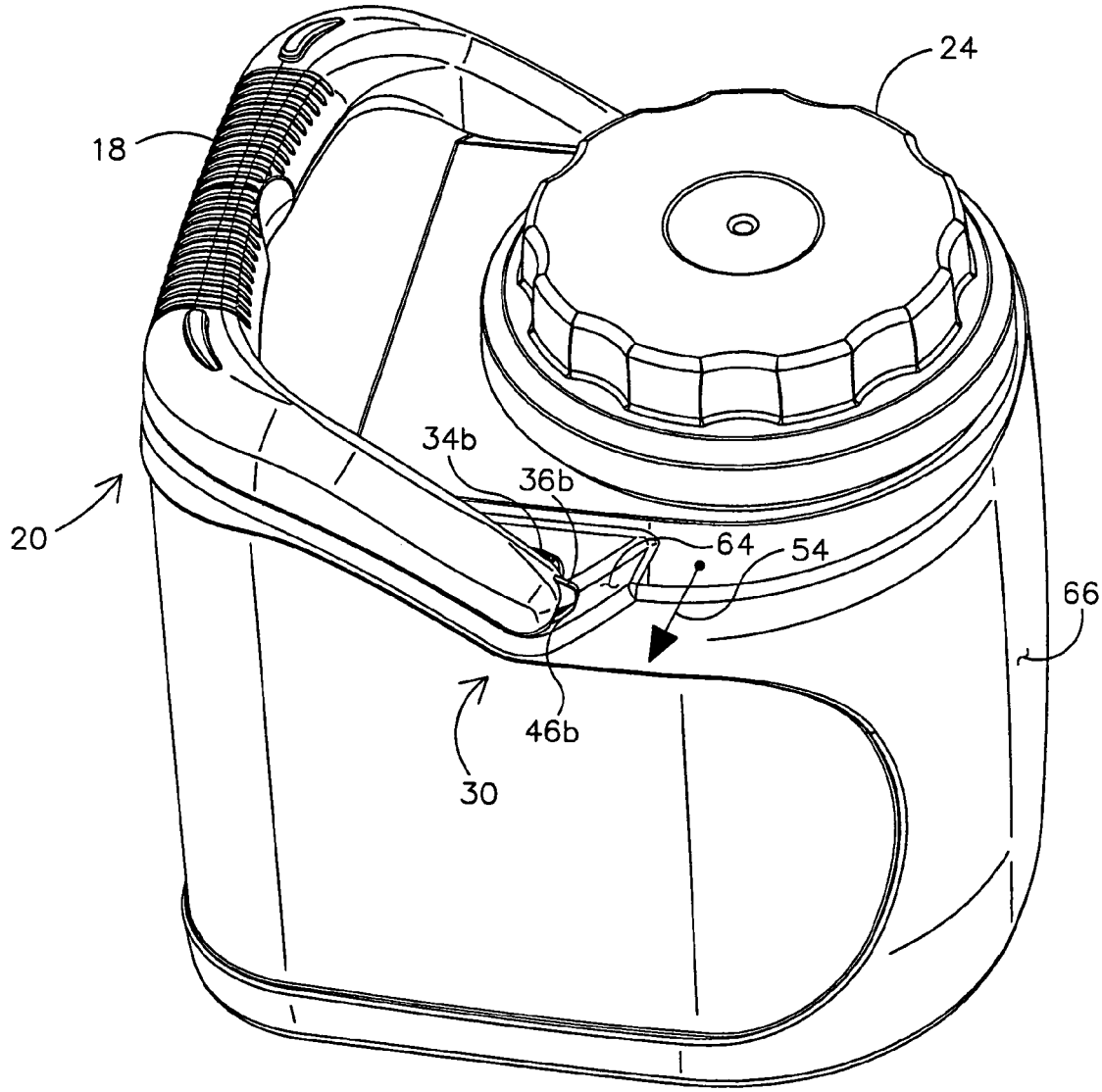
FIG. 2 is a perspective view of the system for containing paint of FIG. 1 showing a handle in a storage position according to an exemplary embodiment.
Figure 3:
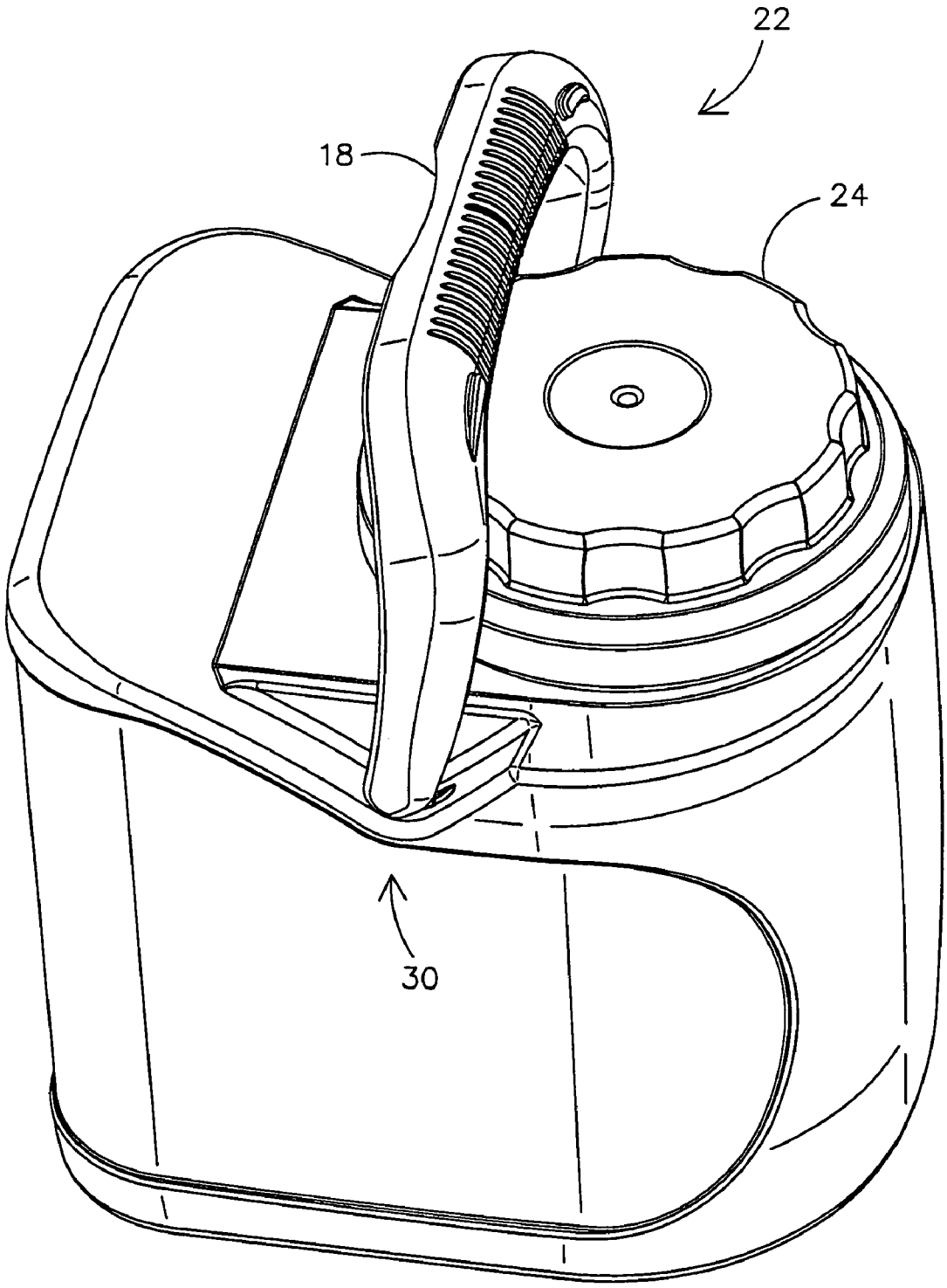
FIG. 3 is a perspective view of the system for containing paint of FIG. 1 showing the handle in a use position according to an exemplary embodiment.
Figure 4:
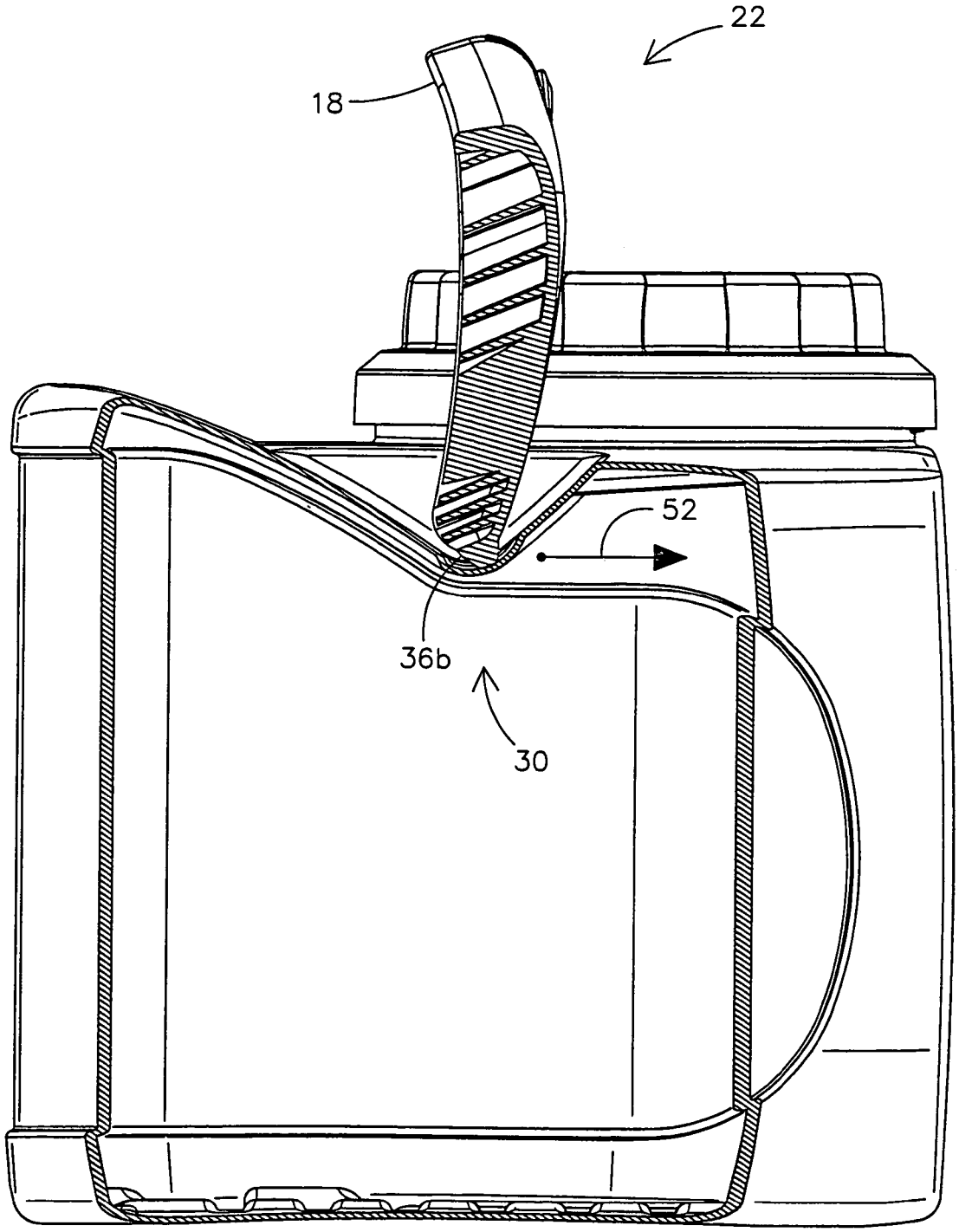
FIG. 4 is a side elevation view of the system for containing paint of FIG. 1 showing the handle in the use position according to an exemplary embodiment.

Referring to FIGS. 2 and 5, locking mechanism 30 includes a first butt or male portion 32*a* and a second male portion 32*b*, each respectively terminating from an end of handle 18. Locking mechanism 30 also includes a first female portion 40*a* and a second female portion 40*b*, each respectively in side wall 14 of body 12. Male portions 32*a* and 32*b* each comprise a cylindrical member or first protrusion 34*a* and a second protrusion 34*b*. A distance 50 extends between first protrusion 34*a* and second protrusion 34*b* of the respective ends of handle 18 (see FIG. 1). Male portions 32*a* and 32*b* each also comprise a wedge-shaped "ear" or a first tab 36*a* and a second tab 36*b*, each respectively extending from the respective ends of handle 18 (see FIG. 4). Protrusion 34*a* and a corresponding protrusion 34*b* may have a cutout 38 as shown in FIGS. 5 and 6 according to an alternative embodiment. The protrusion also may have a "+" or cross shape according to another alternative embodiment.

Referring further to FIGS. 1 and 5, female portions 40*a* and 40*b* of locking mechanism 30 comprise a cylindrical shaped cavity or first recess 42*a* and a second recess 42*b*, each respectively in side wall 14. Recess 42*a* and recess 42*b* each may have a "+" or cross shape corresponding to the shape of the protrusion according to an alternative embodiment as shown in FIGS. 1 and 5.

A first horizontal land 44*a* and a second horizontal land 44*b* are each respectively offset from side wall 14 according to a preferred embodiment as shown in FIGS. 1 and 5. A track or first groove 46*a* and a track or second groove 46*b* each respectively extend into horizontal land 44*a* and horizontal land 44*b* according to a preferred embodiment as shown in FIGS. 1 and 5. A first vertical land 48*a* and a second vertical land 48*b* are each respectively offset from side wall 14 according to a preferred embodiment as shown in FIGS. 1 and 5. A first recess 42*a* and a second recess 42*b* each respectively extend into vertical land 48*a* and vertical land 48*b* according to a preferred embodiment as shown in FIGS. 1 and 5.

According to a preferred embodiment as shown in FIGS. 1 and 5, horizontal land 44*a* and horizontal land 44*b* are each respectively generally perpendicular to vertical land 48*a* and vertical land 48*b*. According to a preferred embodiment as shown in FIGS. 1 and 5, handle 18 in storage position 20 rests against a portion 64 of horizontal land 44*a*. The horizontal and vertical lands may be in any part of the body, including the side wall or the cover according to any preferred or alternative embodiment. According to a preferred embodiment as shown in FIG. 1, horizontal land 44*b* is contiguous with side wall 14 and vertical land 48*b*, and vertical land 48*b* is contiguous with cover 28.

A non-circular cross-section of protrusion 34*a* and protrusion 34*b* each respectively provide an interference fit with recess 42*a* and recess 42*b* (respectively) as handle 18 is pivoted between storage position 20 and use position 22 (see FIG. 5). The interference fit between protrusion 34*a* in recess 42*a* and tab 36*a* in groove 46*a* each respectively assists in maintaining or retaining handle 18 in any position (e.g. an intermediate position between the fully closed position and the fully opened position). The interference fit acts to both hold the handle at a given position as well as resist movement relative to the body.

Handle 18 may be pivoted (e.g. manually by a user) between storage position 20 and use position 22. In use position 22, protrusion 34*a* is inserted in recess 42*a*, and tab 36*a* is in groove 46*a* as shown in FIG. 6. Tab 36*a* travels in groove 46*a* as handle 18 is pivoted between storage position 20 and use position 22.

In use position 22, the top surface of protrusion 34*a* engages the outer wall of recess 42*a* to support the weight of container 10 (see FIG. 6). Protrusion 34*a* inhibits handle 18 from fore and aft movement along a vector 52 in a plane parallel to base 16. Tab 36*a* in groove 46*a* inhibits protrusion 34*a* from being removed from recess 42*a* (e.g. due to helical or twisting motion of handle 18 in use position 22 when container 10 is carried by a user)—thus inhibiting handle 18 from being moved in an inward and outward direction in a plane parallel to side wall 14 along a vector 54. Length 62 of protrusion 34*a* and protrusion 34*b* each respectively in recess 42*a* and recess 42*b* also inhibit handle 18 from being moved in the inward and outward direction in a plane parallel to side wall 14 along vector 54.

According to alternative embodiments, other mechanical fastening structures may also be employed for the locking mechanism. Additionally, a snap in feature that releasably locks the handle in the rest or in the use position may be helpful to ensure the handle does not move. The snap or lock feature may be accomplished by irregular geometry of the handle tabs and land apertures, or any other known means for securing a handle in specific position relative to the container.

According to a preferred embodiment as shown in FIG. 1, side wall 14 includes an inward recess 58 providing a display area for indicia (e.g. label). According to a preferred embodiment as shown in FIG. 2, handle 18 is "flush" or even with side wall 14 (i.e. does not extend beyond the outer periphery of body 12) which may assist in storage and shipping of container 10. According to a preferred embodiment as shown in FIG. 1, a region 66 of body 12 is "label free," intended in part to inhibit paint from spilling onto the label in the area proximate to spout 56.

According to a particularly preferred embodiment, the container has a perimeter that is "D"-shaped, a cross-section that is substantially "D"-shaped, and a substantially flat bottom that is substantially "D"-shaped. According to a particularly preferred embodiment, the container is configured to hold a volume of about one gallon of paint, and may have other volumes (e.g. one quart) according to other alternative embodiments. According to a particularly preferred embodiment, the lid of the container has an area of about 12.4 square inches. According to a particularly preferred embodiment, the container is of the type disclosed in U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001.

Referring further to FIGS. 1 and 5, to install handle 18 on side wall 14, handle 18 is placed in storage position 20. Protrusion 34*a* is inserted into recess 42*a*. Protrusion 34*b* is biased away from protrusion 34*a* beyond vertical land 48*b*. Protrusion 34*b* is then inserted in recess 42*b*. According to a preferred embodiment, protrusion 34*a* may be biased toward protrusion 34*b* when handle 18 is in storage position 20 (e.g. due to an elastic or resilient property of the material or shape of the handle). Tab 36*b* is outside of groove 46*b* (and tab 36*a* is outside of groove 46*a*) when handle 18 is in storage position 20 as shown in FIG. 2 according to an exemplary embodiment.

To remove handle 18 from side wall 14, handle 18 is moved to storage position 20. Protrusion 34*a* is biased away from protrusion 34*b* (e.g. manually by a user). A length 62 of protrusion 34*a* is removed from recess 42*a*. Protrusion 34*a* is offset from recess 42*a* (e.g. by twisting or pivoting handle 18). Protrusion 34*b* is then removed from recess 42*b*.

It is important to note that the construction and arrangement of the elements of the paint container as shown in the preferred and other exemplary embodiments is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the preferred and other exemplary embodiments without departing from the spirit of the present invention as expressed in the appended claims.

What is claimed is:

1. A system for containing paint comprising:

a one piece body having a base, a sidewall extending upwardly from the base, a neck extending upwardly from the side walls, an interior cavity for holding paint is defined by the base and sidewall;

a handle configured for attachment to the body and selectively configurable between a first position in which a central portion of the handle is located above the neck and a different second position;

a locking mechanism comprising:

a pair of protrusions extending from the handle configured for insertion into a respective pair of recesses extending toward one another and into the body;

a tab extending from the end of the handle in a direction away from the central portion of the handle, the tab being configured for selective insertion into a groove of the body, the groove extending downwardly into the body toward the base, the groove being located further away from the neck than the recesses;

wherein the locking mechanism is configured to inhibit movement of the handle in at least two planes when the handle is in the first position.

2. The system of claim 1 wherein the protrusions comprise a first projection that is biased away from a second projection to remove the handle from the body.

3. The system of claim 2 wherein the protrusion are configured to inhibit forward and backward movement of the handle relative to the base.

4. The system of claim 3 wherein the tab is configured to inhibit inward and outward movement of the handle relative to a side wall of the body.

5. The system of claim 4 wherein the tab is outside the groove when the handle is in the storage position.

6. The system of claim 5 wherein the tab is in the groove when the handle is in the first position.

7. The system of claim 5 wherein the protrusion are configured to be installed in the recess only when the handle is in the second position.

8. The system of claim 5 wherein the side wall is an exterior wall of the body.

9. The system of claim 5 wherein the body has a D-shape.

10. The system of claim 5 wherein a cross section of the body has a D-shape, the recesses being located in a region between a front and a rear of the body that is offset from a center of the neck, wherein the handle does not extend beyond an outer periphery of the body.

11. The system of claim 5 wherein the first position is a use position.

12. The system of claim 5 wherein the first position is a vertical position.

13. The system of claim 5 wherein the first position is an up position.

14. The system of claim 5 wherein the second position is a storage position.

15. The system of claim 5 wherein the second position is a horizontal position.

16. The system of claim 5 wherein the second position is a down position.

17. The system of claim 5 wherein the cover comprises a horizontal cover, the base comprises a horizontal base and the body comprises a vertical side wall.

18. A method of using a container for paint comprising a one piece body having a base, a sidewall extending upwardly from the base, a neck extending upwardly from the side walls, an interior cavity for holding paint is formed by the base and sidewall, a handle having a central portion and a first and second leg extending there from, the handle configured for attachment to the side wall, a first protrusion and a second protrusion located on each respective leg of the handle, each protrusion configured for insertion into at least one recess of the side wall, and a tab of the handle configured for selective insertion into a groove of the body, the protrusions extending toward one another, the method comprising:

positioning the handle to an installation position;

biasing the first protrusion away from the second protrusion;

inserting the first protrusion in the recess of the side wall to inhibit movement of the handle between a forward position and a rearward position relative to the base.

19. The method of claim 18 further comprising positioning the handle in a use position wherein the tab is inserted in the groove to inhibit movement of the handle between an inward position and an outward position relative to the side wall.

20. A container comprising;

a body having a base, a side wall extending upwardly from the base, the base and side wall defining an interior cavity capable of holding a liquid, a top portion extending from at least one side wall including a raised threaded neck portion defining an opening into the interior cavity;

a handle having a central portion and two end portions, each end portion including an inwardly extending protrusion and a separate tab proximate to each end portion of the handle and extending in a direction away from the central portion and extending in a direction different from the inwardly extending protrusions;

the body including a pair of first recesses, each first recess located on an opposing side of the body and extending toward one another; and the body including a pair of grooves, each groove located on an opposing side of the body and extending toward the base;

each protrusion of the handle being located in a respective first recess and each tab being received within a respective groove;

the handle being movable between a raised position in which a central portion of the handle is located above the neck and a second lowered position, the protrusions remaining in the recess in the first and second positions, the tabs extending into the grooves in the raised position;

the recesses and grooves being located in a region away from the neck, the grooves being located further from the neck than the recesses.

21. The container of claim 20, wherein the protrusions are located in the respective recesses when the handle is in the raised and second positions and the tabs are not located in the grooves when the handle is in the second position.

22. The container of claim 21, wherein the tabs frictionally engage a bottom portion of the groove as the handle is moved from the second position to the first raised position.

23. The container of claim 20, wherein the interior cavity includes a liquid paint.

* * * * *